US006669447B2

(12) United States Patent
Norris et al.

(10) Patent No.: US 6,669,447 B2
(45) Date of Patent: Dec. 30, 2003

(54) TURBOMACHINE BLADE

(75) Inventors: Jennifer M Norris, Derby (GB); David S Knott, Loughborough (GB); Adrian M Jones, Bristol (GB); David R Midgelow, Nottingham (GB); Robert M Hall, Dorchester (GB)

(73) Assignee: Rolls-Royce plc, London (GB)

( * ) Notice: Subject to any disclaimer, the term of this patent is extended or adjusted under 35 U.S.C. 154(b) by 50 days.

(21) Appl. No.: 10/020,315

(22) Filed: Dec. 18, 2001

(65) Prior Publication Data

US 2002/0090302 A1 Jul. 11, 2002

(30) Foreign Application Priority Data

Jan. 11, 2001 (GB) ..... 0100695

(51) Int. Cl.[7] ..... F01D 5/10

(52) U.S. Cl. ..... 416/224; 416/229 A; 416/233; 416/500; 29/889.72

(58) Field of Search ..... 416/144, 229 A, 416/230, 232, 233, 241 R, 241 A, 500, 224, 223, 193 R; 29/889.71, 889.72

(56) References Cited

U.S. PATENT DOCUMENTS 5,056,738 A 10/1991 Mercer
5,896,658 A * 4/1999 Calle et al. ..... 29/889.72
5,913,661 A * 6/1999 Panovsky et al. ..... 416/229 A
6,039,542 A * 3/2000 Schilling et al. ..... 416/233
6,059,533 A 5/2000 Stoker
6,190,133 B1 * 2/2001 Ress, Jr. et al. ..... 416/229 A

FOREIGN PATENT DOCUMENTS

EP 0 926 312 A 6/1999
FR 1 284 109 A 2/1962
GB 942 386 SP 11/1963
WOWO PCT/US97/16575 A 3/1998

* cited by examiner

*Primary Examiner*—Edward K. Look
*Assistant Examiner*—Dwayne J. White
(74) *Attorney, Agent, or Firm*—W. Warren Taltavull; Manelli, Denison & Selter PLLC

(57) ABSTRACT

A gas turbine engine fan blade (26) comprises a root portion (40) and an aerofoil portion (42). The aerofoil portion (42) has a leading edge (44), a trailing edge (46), a concave metal wall portion (50) extending from the leading edge (44) to the trailing edge (46) and a convex metal wall portion (52) extending from the leading edge (44) to the trailing edge (46). The aerofoil portion (42) has a hollow interior (54) and the interior (54) of the aerofoil portion (42) is at least partially filled with a vibration damping material (56). The vibration damping material (56) comprises a material having viscoelasticity for example one formed by mixing an amine terminated polymer and bisphenol a-epichlorohydrin epoxy resin.

30 Claims, 2 Drawing Sheets

TURBOMACHINE BLADE

FIELD OF THE INVENTION

The present invention relates to a turbomachine blade, for example a compressor blade for a gas turbine engine and in particular to a fan blade for a gas turbine engine.

BACKGROUND OF THE INVENTION

Conventional narrow chord fan blades for gas turbine engines comprise solid metal.

One conventional wide chord fan blade comprises a concave metal wall portion, a convex metal wall portion and a honeycomb between the two metal wall portions. This wide chord fan blade is produced by hot forming the wall portions into concave and convex shapes respectively, placing the honeycomb between the metal wall portions and brazing, or activated diffusion bonding, the metal wall portions together around the honeycomb. The interior of the fan blade is evacuated.

Another conventional wide chord fan blade comprises a concave metal wall portion, a convex metal wall portion and metal walls extending between the two wall portions. This wide chord fan blade is produced by placing a metal sheet between two tapered metal sheets and diffusion bonding the sheets together at predetermined positions to form an integral structure. Then inert gas is supplied into the interior of the integral structure to hot form the integral structure into a die to produce the concave and convex walls and the walls extending between the concave and convex walls. The interior of the fan blade is evacuated.

A disadvantage of a wide chord fan blade is that it is not as stiff as a narrow chord fan blade. The reduced stiffness results in an increased risk of stalled flutter within the operating range of the gas turbine engine and an increased susceptibility to other forms of vibration. A further disadvantage of the wide chord fan blade is that it is very expensive and time consuming to produce.

SUMMARY OF THE INVENTION

Accordingly the present invention seeks to provide a novel turbomachine blade which reduces, preferably overcomes, the above mentioned problems.

Accordingly the present invention provides a turbomachine blade comprising a root portion and an aerofoil portion, the aerofoil portion having a leading edge, a trailing edge, a concave metal wall portion extending from the leading edge to the trailing edge and a convex metal wall portion extending from the leading edge to the trailing edge, the concave metal wall portion and the convex metal wall portion forming a continuous integral metal wall, the aerofoil portion having a hollow interior defined by at least one internal surface, the hollow interior of the aerofoil portion being at least partially filled with a vibration damping material, the vibration damping material being bonded to the at least one internal surface and the vibration damping material comprising a material having viscoelasticity.

Viscoelasticity is a property of a solid or liquid which when deformed exhibits both viscous and elastic behaviour through the simultaneous dissipation and storage of mechanical energy.

Preferably the whole of the interior of the aerofoil portion is filled with vibration damping material.

Preferably the vibration damping material comprises a polymer. The vibration damping material may comprise a structural epoxy resin. The vibration damping material may contain glass microspheres, polymer microspheres or a mixture of glass microspheres and polymer microspheres. The vibration damping material may be formed by mixing an amine terminated polymer and bisphenol a-epichlorohydrin epoxy resin.

Preferably the turbomachine blade is a compressor blade or a fan blade.

The present invention also provides method of manufacturing a turbomachine blade from at least two metal workpieces comprising the steps of:

(a) forming at least two metal workpieces, (b) applying stop off material to a predetermined area of a surface of at least one of the at least two metal workpieces, (c) arranging the workpieces in a stack such that the stop off material is between the at least two metal workpieces, (d) heating and applying pressure across the thickness of the stack to diffusion bond the at least two workpieces together in areas other than the preselected area to form an integral structure, (e) heating and internally pressurising the interior of the integral structure to hot form the at least two metal workpieces into an aerofoil shape to form a turbomachine blade having a hollow interior defined by at least one internal surface, (f) cleaning the internal surface of the hollow interior of the turbomachine blade, (g) supplying a vibration damping material into the hollow interior of the turbomachine blade and bonding the vibration damping material to the internal surface, the vibration damping material comprising a material having viscoelasticity, and (h) sealing the hollow interior of the turbomachine blade.

Preferably each of the at least two sheets has at least one flat surface and the flat surfaces of the at least two sheets are arranged to abut each other.

Preferably the at least two sheets increase in thickness longitudinally from a first end to a second end.

Preferably the second ends of each of the at least two sheets are arranged adjacent to each other to form the root of the turbomachine blade.

Preferably step (d) comprises heating to a temperature greater then 850° C. and applying a pressure greater than $20\times10^5$ $Nm^{-2}$.

Preferably step (d) comprises heating to a between 900° C. and 950° C. and applying a pressure between $20\times10^5$ $Nm^{-2}$ and $30\times10^5$ $Nm^{2}$.

Preferably step (e) comprises heating to a temperature between 700° C. and 850° C.

Alternatively step (e) comprises heating to a temperature between 850° C. and 950° C.

Preferably the at least two metal workpieces comprise titanium or a titanium alloy.

Preferably the vibration damping material comprises a polymer. The vibration damping material may comprise a structural epoxy resin. The vibration damping material may contain glass microspheres, polymer microspheres or a mixture of glass microspheres and polymer microspheres. The vibration damping material may be formed by mixing an amine terminated polymer and bisphenol a-epichlorohydrin epoxy resin.

Preferably step (f) comprises sequentially flushing the hollow interior of the turbomachine blade with nitric acid, a neutraliser and water to remove the stop off material from the internal surfaces of the hollow interior of the turbomachine blade.

BRIEF DESCRIPTION OF THE DRAWINGS

The present invention will be more fully described by way of example with reference to the accompanying drawings in which.

DETAILED DESCRIPTION OF THE INVENTION

Figure 1:
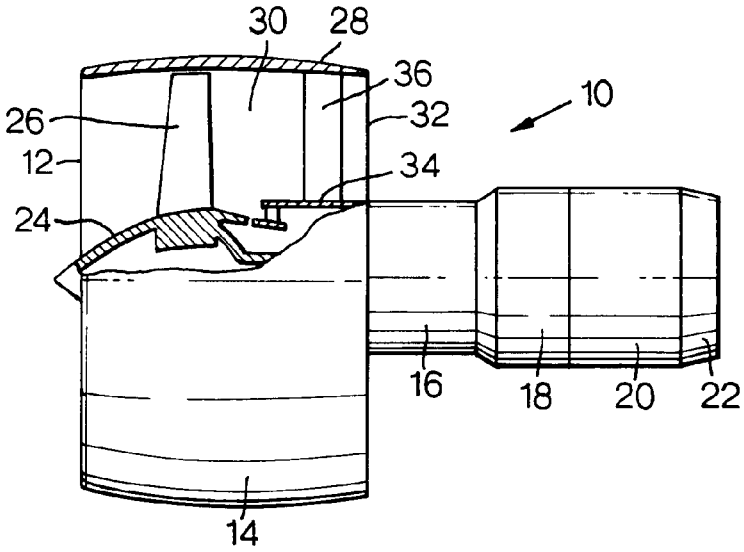
FIG. 1 shows a gas turbine engine having a blade according to the present invention.

A turbofan gas turbine engine 10, as shown in FIG. 1, comprises in axial flow series an inlet 12, a fan section 14, a compressor section 16, a combustion section 18, a turbine section 20 and an exhaust 22. The fan section 14 comprises a fan rotor 24 carrying a plurality of equi-angularly-spaced radially outwardly extending fan blades 26. The fan blades 26 are surrounded by a fan casing 28 which defines a fan duct 30 and the fan duct 30 has an outlet 32. The fan casing 28 is supported from a core engine casing 34 by a plurality of radially extending fan outlet guide vanes 36.

The turbine section 20 comprises one or more turbine stages to drive the compressor section 18 one or more shafts (not shown). The turbine section 20 also comprises one or more turbine stages to drive the fan rotor 24 of the fan section 14 via a shaft (not shown).

Figure 2:
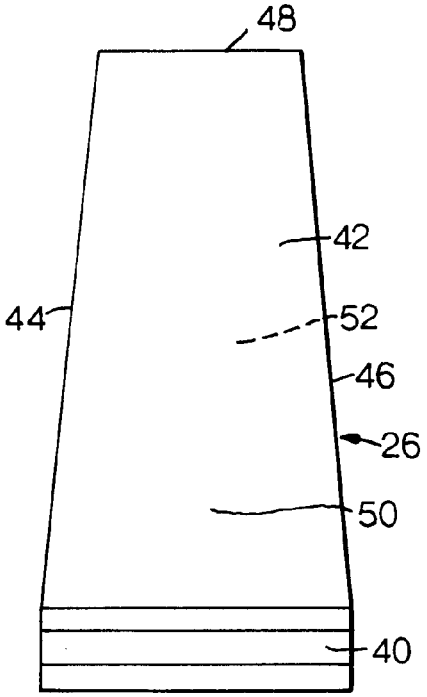
FIG. 2 is an enlarged view of a fan blade according to the present invention.
Figure 3:
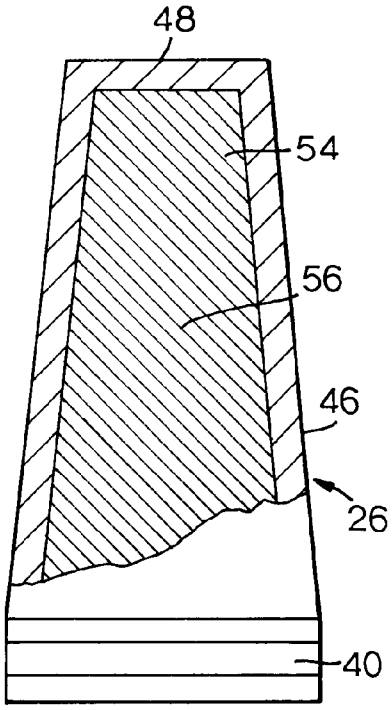
FIG. 3 is a cut away view through the fan blade shown in FIG. 2.
Figure 4:
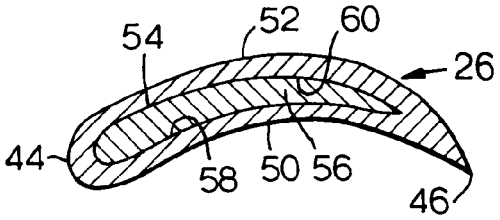
FIG. 4 is a cross-sectional view in the direction of arrows A—A in FIG. 3.

One of the fan blades 26 is shown in more detail in FIGS. 2, 3 and 4. The fan blade 26 comprises a root portion 40 and an aerofoil portion 42. The root portion 40 comprises a dovetail root, a firtree root, or other suitably shaped root for fitting in a correspondingly shaped slot in the fan rotor 26. The aerofoil portion 42 has a leading edge 44, a trailing edge 46 and a tip 48. The aerofoil portion 42 comprises a concave wall 50 which extends from the leading edge 44 to the trailing edge 46 and a convex wall 52 which extends from the leading edge 44 to the trailing edge 46. The concave and convex walls 50 and 52 respectively comprise a metal for example a titanium alloy. The aerofoil portion 42 has a hollow interior 54 and at least a portion, preferably the whole, of the hollow interior 54 of the aerofoil portion 42 is filled with a vibration damping material 56.

The vibration damping material 56 comprises a material having viscoelasticity. Viscoelasticity is a property of a solid or liquid which when deformed exhibits both viscous and elastic behaviour through the simultaneous dissipation and storage of mechanical energy.

The vibration damping material 56 is bonded to the interior surfaces 58 and 60 of the concave and convex walls 50 and 52. The vibration damping material 56 is bonded to the interior surfaces 58 and 60 such that the vibration damping material 56 remains in contact with the interior surfaces 58 and 60 of the concave and convex walls 50 and 52 respectively.

The vibration damping material 56 comprises a polymer, the vibration damping material 56 may comprise a structural epoxy resin. The vibration damping material 56 contains glass microspheres. The glass microspheres are to control the density of the vibration damping material and increase the stiffness of the vibration damping material.

In operation of the turbofan gas turbine engine 10 any vibrations of the fan blade 26 are damped by the vibration damping material 56 in the hollow interior 54 of the fan blade 26. The vibration damping material 56 damps the vibrations of the fan blade 26 by removing energy from the vibrations because of its viscoelasticity. The vibration of the fan blade 26 creates shear in the vibration damping material 56 and the shear causes a proportion of the energy of vibration to be transmitted, or lost, as heat thereby damping vibrations of the fan blade 26.

The hollow interior 48 of the aerofoil portion 42 of a fan blade 26 was completely filled by vibration damping material 56.

In one example the vibration damping material 56 was "Scotchweld" (Trade Mark of 3M) and sold under the product number EC2216B/A. This vibration damping material comprises a translucent epoxy adhesive with glass microspheres and is formed by mixing a product A, an amine terminated polymer, and a product B, a bisphenol a-epichlorohydrin epoxy resin. In this example the vibration damping material 56 itself is an adhesive.

In a series of tests the vibration damping performance of conventional wide chord fan blades produced by diffusion bonding and superplastic forming three metal sheets was compared to wide chord fan blades according to the present invention. The conventional wide chord fan blades and wide chord fan blades according to the present invention were clamped in a root fixture, placed in an oven and heated up to a temperature of 80° C. The wide chord fan blades were struck at anti-nodes with a soft-headed hammer and the vibration response measured for the first three vibration modes at a temperature of 80° C. The vibration response was measured at other temperatures as the wide chord fan blades cooled. It was found that the fan blades according to the present invention had better vibration damping performance. It was found that the temperature had an effect on the damping of the wide chord fan blades according to the present invention. In particular peak damping was obtained when the wide chord fan blades according to the present invention were at a temperature in the range 40° C. to 60° C.

Figure 5:
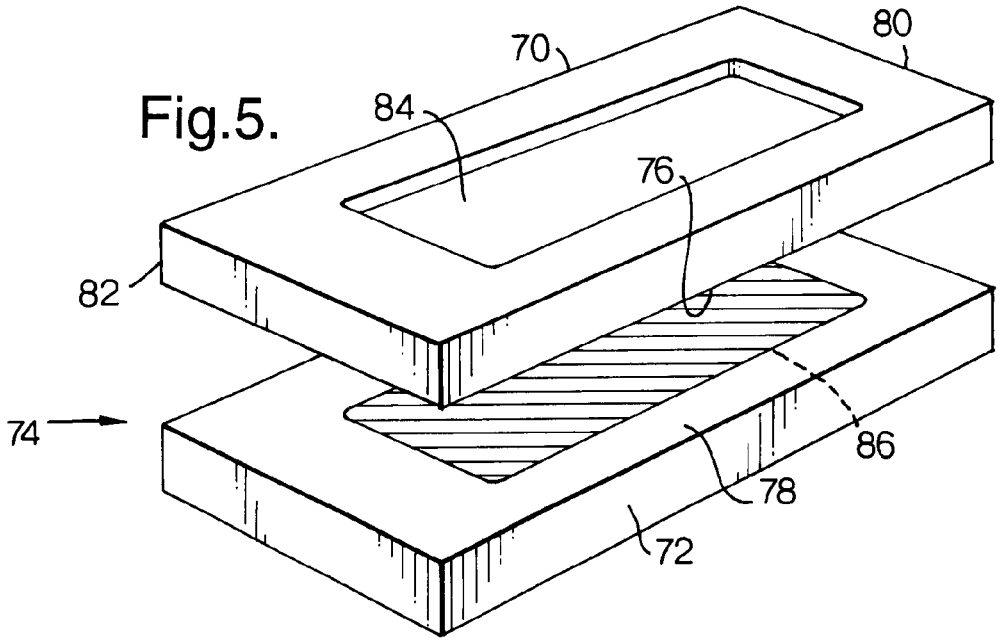
FIG. 5 is an exploded view of a stack of workpieces used to manufacture the fan blade shown in FIGS. 2 to 4.

The fan blades 26 are manufactured, as shown in FIG. 5, from two sheets of titanium alloy 70 and 72 which are assembled into a stack 74. The sheets 70 and 72 have flat surfaces, 76 and 78, which are arranged to abut each other. The sheets 70 and 72 taper, increasing in thickness, longitudinally from the end 80 to the end 82. The thickest ends of the sheets 70 and 72 are arranged adjacent to each other to form the root 40 of the fan blade 26.

The titanium alloy sheets 70 and 72 are produced by cutting an original parallelepiped block of titanium alloy along an inclined plane to form the two longitudinally tapering titanium alloy sheets 70 and 72 as described more fully in our UK patent GB2306353B.

The central regions 84 and 86 of the sheets 70 and 72 are machined to produce a variation in the mass distribution of the fan blade 26 from leading edge 44 to trailing edge 46 and from root 40 to tip 48. The machining of the central regions 84 and 86 is by milling, electrochemical machining, chemical machining, electrodischarge machining or any other suitable machining process.

The abutting surfaces 76 and 78 are prepared for diffusion bonding by chemical cleaning. One of the surfaces 76 and 78 has a stop off material applied over most of its surface except for the periphery. The stop off may comprise yttria.

A pipe is interconnected to the stop off material and the sheets 70 and 72 are welded together around their peripheries to form the stack 74 and the pipe is welded to the stack 74 to form a welded assembly.

The pipe is connected to a vacuum pump, which is used to evacuate the interior of the welded assembly and then inert gas, for example argon, is used to purge the interior of the welded assembly. The welded assembly is placed in an oven and is heated to a temperature between 250° C. and 350° C. to evaporate the binder from the stop off material and the welded assembly is continuously evacuated to remove the binder.

After the binder has been removed the pipe is sealed so that there is a vacuum in the welded assembly and the welded assembly is placed in an autoclave. The temperature in the autoclave is increased to a temperature greater then 850° C. and the pressure is increased to greater than $20\times10^5$ $Nm^{-2}$ and held at that pressure for a predetermined time to diffusion bond the metal sheets 70 and 72 together to form an integral structure. Preferably the temperature is between 900° C. and 950° C. and the pressure is between $20\times10^5$ $Nm^{-2}$ and $30\times10^5$ $Nm^{-2}$.

The interior of the integral structure is then placed in a hot creep-forming die and hot creep formed to produce an aerofoil shape. During the hot creep forming process the integral structure is heated to a temperature of 740° C.

The pipe is replaced by another pipe. The hot creep formed integral structure is placed in a hot forming die, which comprises a concave surface and a convex surface. Inert gas, for example argon, is introduced, through the pipe, into the areas within the interior of the hot creep formed integral structure containing the stop off material to break the adhesive grip which the diffusion bonding pressure has brought about. This is carried out at room temperature or at hot forming temperature.

The hot creep formed structure and hot forming die is placed in an autoclave. The hot creep formed integral structure is heated to a temperature suitable for hot forming. The temperature for superplastic forming is greater than 850° C., preferably 900° C. to 950° C. The temperature for hot forming is preferably less than that for superplastic forming, for example 700° C. to 850° C. Inert gas, for example argon, is introduced, through the pipe, into the interior of the hot creep formed integral structure so as to hot form the sheets 70 and 72 onto the surface of the die to form the concave and convex walls 50 and 52 and the hollow interior 54 of the fan blade 26.

The fan blade 26 is allowed to cool and the hollow interior 54 of the fan blade 26 is sequentially flushed with nitric acid, a neutraliser and water to remove all the stop off material, yttria, from the internal surfaces of the hollow interior 54 of the fan blade 26 and to prepare the interior surfaces 58 and 60 for bonding. Then the viscoelastic damping material 56 is supplied, through the pipe, into the hollow interior 54 of the fan blade 26. Preferably the viscoelastic material is supplied through a pipe at the root end of the fan blade 26. The viscoelastic damping material 56 is allowed to cure in the fan blade 26 and to bond to the interior surface 58 and 60 of the hollow interior 54 of the fan blade 26. The hollow interior 54 of the fan blade 26 is sealed by welding across the pipe entry into the fan blade 26 to prevent the vibration damping material 56 escaping from the fan blade 26.

The method of manufacturing the fan blade 26 dispenses with the need for the third metal sheet to form the interconnecting walls reducing the amount of titanium alloy used and reducing machining time. Additionally the temperature for hot forming the hot creep formed integral structure is less than that required for superplastic forming the third metal sheet.

Figure 6:
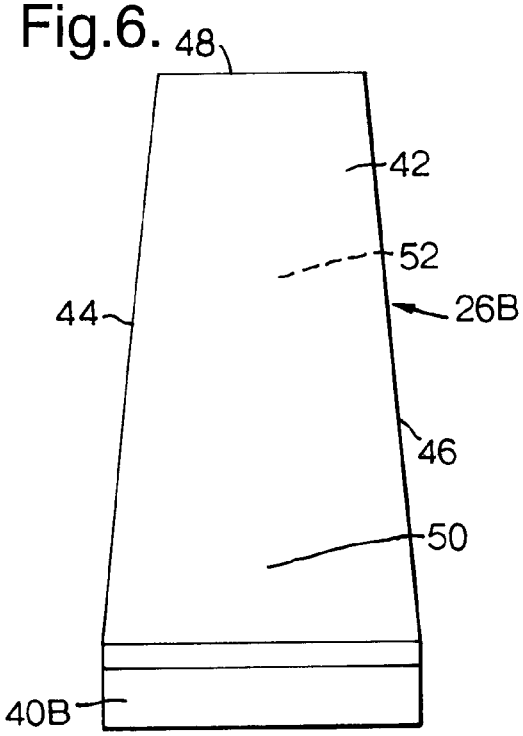
FIG. 6 is an enlarged view of an alternative fan blade according to the present invention.
Figure 7:
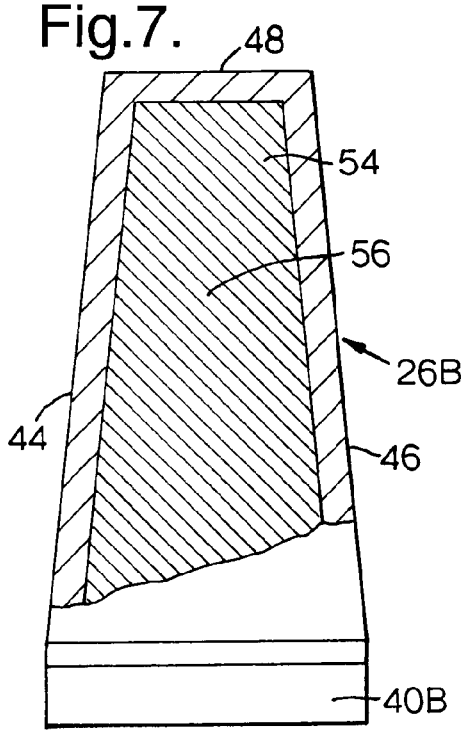
FIG. 7 is a cut away view through the fan blade in FIG. 6.

Another of the fan blades 26B is shown in more detail in FIGS. 6 and 7. The fan blade 26B comprises a root portion 40 and an aerofoil portion 42. The root portion 40B comprises a shaped foot to enable, the fan blade 26B to be secured to the fan rotor 24 by friction welding, diffusion bonding or other suitable welding or bonding process, for example linear friction welding. The aerofoil portion 42 has a leading edge 44, a trailing edge 46 and a tip 48. The aerofoil portion 42 comprises a concave wall 50 which extends from the leading edge 44 to the trailing edge 46 and a convex wall 52 which extends from the leading edge 44 to the trailing edge 46. The concave and convex walls 50 and 52 respectively comprise a metal for example a titanium alloy. The aerofoil portion 42 has a hollow interior 54 and at least a portion, preferably the whole, of the hollow interior 54 of the aerofoil portion 42 is filled with a vibration damping material 56.

The vibration damping material 56 comprises a material having viscoelasticity. Viscoelasticity is a property of a solid or liquid which when deformed exhibits both viscous and elastic behaviour through the simultaneous dissipation and storage of mechanical energy.

The vibration damping material 56 is bonded to the interior surfaces 58 and 60 of the concave and convex walls 50 and 52. The vibration damping material 56 is bonded to the interior surfaces 58 and 60 such that the vibration damping material 56 remains in contact with the interior surfaces 58 and 60 of the concave and convex walls 50 and 52 respectively.

In the case of the fan blade 26 in FIGS. 2 to 4 the root portion 40 is machined to produce a dovetail root or a firtree root either before, or after, the vibration damping material 56 is supplied into the hollow interior 54 of the fan blade 26.

However, in the case of the fan blade 26B in FIGS. 6 and 7 the root portion 40B is friction welded or diffusion bonded to the fan rotor 26, for example by linear friction welding, and is subsequently heat treated before the vibration damping material 56 is supplied into the hollow interior 54 of the fan blade 26B.

Other suitable polymers may be used as the vibration damping material 56, for example other two part epoxy resins may be used. The vibration damping material may also contain polymer microspheres, glass microspheres or a mixture of polymer microspheres and glass microspheres to control the density of the vibration damping material. The polymer microspheres for example may reduce the density of the vibration damping material from about 1.25 $g/cm^3$ for a vibration damping material without microspheres to about 0.3 g/cm3 for a vibration damping material containing polymer microspheres. The proportion of microspheres is tailored to the particular fan blade. Suitable polymer microspheres are 'Expancel' (Trademark of AKZO Nobel) and sold under the product number DE551. The mircrospheres are hollow.

One part thermosetting adhesive and filler vibration damping materials may be used to aid filling of the fan blades, due to their lower viscosity prior to curing. These one part thermosetting adhesive and filler vibration damping materials are supplied into the hollow interior of the fan blade 26 and the fan blade 26 is vibrated, centrifuged or spun to ensure the vibration damping material totally fills the fan blade 26. The fan blade 26 is then non destructively tested to ensure total filling of the fan blade 26, for example by X-ray etc, before the fan blade 26 and one part thermosetting, adhesive and filler, vibration damping material is heated to the curing temperature to cure the one part thermosetting, adhesive and filler, vibration damping material. A one part thermosetting adhesive for example is sold under the product number DJ144 by Permabond and this is mixed with a suitable filler of polymer microspheres, glass microspheres or mixture of glass microspheres and polymer microspheres.

The vibration damping material may comprise a liquid crystal elastomer, for example polysiloxane, which has damping properties, shear properties, at higher temperatures.

The fan blades 26 and 26B have an advantage of having a continuous integral metal wall 50 and 52 around the vibration damping material 56, which minimises the possibility of release of the vibration damping material 56 into the gas turbine engine 10. This also minimises the possibility of damage to other components of the gas turbine engine 10. The provision of the vibration damping material 56 completely within the hollow interior 54 of the fan blades 26 and 26B, defined by the integral metal walls 50 and 52 allows the aerodynamic shape and the integrity of the fan blades 26 and 26B to be maintained. The shape and size of the hollow interior 54 and vibration damping material 56 may be selected to control the weight of the fan blades 26 and 26B. The vibration damping material 56 properties may be selected for the resonant frequency of the fan blades 26 and 26B or mode shape of the fan blades 26 and 26B.

The vibration damping material 56 is easily incorporated into the fan blades 26 and 26B without impairing the aerodynamic shape or integrity of the fan blades 26 and 26B and without additional machining, forming or forging process steps.

Although the invention has been described with reference to a fan blade it is equally applicable to a compressor blade and a turbine blade.

Although the invention has been described with reference to titanium alloy blades it is equally applicable to other metal alloy, metal or intermetallic blades.

We claim:

1. A turbomachine blade comprising a root portion and an aerofoil portion, the aerofoil portion having a leading edge, a trailing edge, a concave metal wall portion extending from the leading edge to the trailing edge and a convex metal wall portion extending from the leading edge to the trailing edge, the concave metal wall portion and the convex metal wall portion forming a continuous integral metal wall without any interruptions, the aerofoil portion having a hollow interior defined by at least one internal surface, the hollow interior of the aerofoil portion being at least partially filled with a vibration damping material, the vibration damping material being bonded to the at least one internal surface and the vibration damping material comprising a material having viscoelasticity.

2. A turbomachine blade as claimed in claim 1 wherein the whole of the interior of the aerofoil portion is filled with vibration damping material.

3. A turbomachine blade as claimed in claim 1 wherein the vibration damping material contains glass microspheres, polymer microspheres or a mixture of glass microspheres and polymer microspheres.

4. A turbomachine blade as claimed in claim 1 wherein the vibration damping material is formed by mixing an amine terminated polymer and bisphenol a-epichlorohydrin epoxy resin.

5. A turbomachine blade as claimed in claim 1 wherein the turbomachine blade is selected from the group comprising a compressor blade and a fan blade.

6. A turbomachine blade as claimed in claim 1 wherein the concave and convex metal wall portions comprise titanium or a titanium alloy.

7. A turbomachine blade as claimed in claim 1 wherein the root portion comprises a dovetail root or a firtree root.

8. A gas turbine engine comprising a turbomachine blade as claimed in claim 1.

9. A turbomachine blade as claimed in claim 1 wherein the vibration damping material comprises a polymer.

10. A turbomachine blade as claimed in claim 9 wherein the vibration damping material comprises a structural epoxy resin.

11. A method of manufacturing a turbomachine blade from at least two metal workpieces comprising the steps of:

(a) forming at least two metal workpieces, (b) applying stop off material to a predetermined area of a surface of at least one of the at least two metal workpieces, (c) arranging the workpieces in a stack such that the stop off material is between the at least two metal workpieces, (d) heating and applying pressure across the thickness of the stack to diffusion bond the at least two workpieces together in areas other than the preselected area to form an integral structure, (e) heating and internally pressurising the interior of the integral structure to hot form the at least two metal workpieces into an aerofoil shape to form a turbomachine blade having a hollow interior defined by at least one internal surface, (f) cleaning the internal surface of the hollow interior of the turbomachine blade, (g) supplying a vibration damping material into the hollow interior of the turbomachine blade and bonding the vibration damping material to the internal surface, the vibration damping material comprising a material having viscoelasticity, and (h) sealing the hollow interior of the turbomachine blade.

12. A method as claimed in claim 11 wherein each of the at least two sheets has at least one flat surface and the flat surfaces of the at least two sheets are arranged to abut each other.

13. A method as claimed in claim 11 wherein step (e) comprises heating to a temperature between 700° C. and 850° C.

14. A method as claimed in claim 11 wherein step (e) comprises heating to a temperature between 850° C. and 950° C.

15. A method as claimed in claim 11 wherein the at least two metal workpieces are selected from a group comprising titanium and a titanium alloy.

16. A method as claimed in claim 11 wherein the vibration damping material contains glass microspheres, polymer microspheres or a mixture of glass microspheres and polymer microspheres.

17. A method as claimed in claim 11 wherein the vibration damping material is formed by mixing an amine terminated polymer and bisphenol a-epichlorohydrin epoxy resin.

18. A method as claimed in claim 11 wherein step (f) comprises sequentially flushing the hollow interior of the turbomachine blade with nitric acid, a neutraliser and water to remove the stop off material from the internal surfaces of the hollow interior of the turbomachine blade.

19. A method as claimed in claim 11 wherein step (d) comprises heating to a temperature greater then 850° C. and applying a pressure greater than $20\times10^5$ $Nm^{-2}$.

20. A method as claimed in claim 19 wherein step (d) comprises heating to a between 900° C. and 950° C. and applying a pressure between $20\times10^5$ $Nm^{-2}$ and $30\times10^5$ $Nm^{-2}$.

21. A method as claimed in claim 11 wherein the at least two sheets increase in thickness longitudinally from a first end to a second end.

22. A method as claimed in claim 21 wherein the second ends of each of the at least two sheets are arranged adjacent to each other to form the root of the turbomachine blade.

23. A method as claimed in claim 22 comprising before step (g) or after step (g) the step of machining the root of the turbomachine blade to form a dovetail root or a firtree root.

24. A method as claimed in claim 22 comprising before step (g) the step of bonding the root of the turbomachine blade to a turbomachine rotor.

25. A method as claimed in claim 24 wherein the bonding comprises friction welding, linear friction welding or diffusion bonding.

26. A method as claimed in claim 11 wherein the vibration damping material comprises a polymer.

27. A method as claimed in claim 26 wherein the vibration damping material comprises a structural epoxy resin.

28. A turbomachine blade comprising a root portion and an aerofoil portion, the aerofoil portion having a leading edge, a trailing edge, a concave metal wall portion extending from the leading edge to the trailing edge and a convex metal wall portion extending from the leading edge to the trailing edge, the concave metal wall portion and the convex metal wall portion forming a continuous integral metal wall, the aerofoil portion having a hollow interior defined by at least one internal surface, the hollow interior of the aerofoil portion being at least partially filled with a vibration damping material, the vibration damping material being bonded to the at least one internal surface and the vibration damping material comprising a material having viscoelasticity and comprises a structural epoxy resin polymer.

29. A turbomachine blade comprising a root portion and an aerofoil portion, the aerofoil portion having a leading edge, a trailing edge, a concave metal wall portion extending from the leading edge to the trailing edge and a convex metal wall portion extending from the leading edge to the trailing edge, the concave metal wall portion and the convex metal wall portion forming a continuous integral metal wall, the aerofoil portion having a hollow interior defined by at least one internal surface, the hollow interior of the aerofoil portion being at least partially filled with a vibration damping material, the vibration damping material being bonded to the at least one internal surface and the vibration damping material comprising a material having viscoelasticity and wherein the vibration damping material contains glass microspheres, polymer microspheres or a mixture of glass microspheres and polymer microspheres.

30. A turbomachine blade comprising a root portion and an aerofoil portion, the aerofoil portion having a leading edge, a trailing edge, a concave metal wall portion extending from the leading edge to the trailing edge and a convex metal wall portion extending from the leading edge to the trailing edge, the concave metal wall portion and the convex metal wall portion forming a continuous integral metal wall, the aerofoil portion having a hollow interior defined by at least one internal surface, the hollow interior of the aerofoil portion being at least partially filled with a vibration damping material, the vibration damping material being bonded to the at least one internal surface and the vibration damping material comprising a material having viscoelasticity and wherein the vibration damping material is formed by mixing an amine terminated polymer and bisphenol a-epichlorohydrin epoxy resin.

* * * * *